US007742026B2

(12) United States Patent
Lee et al.

(10) Patent No.: US 7,742,026 B2
(45) Date of Patent: Jun. 22, 2010

(54) METHOD OF DETERMINING OLED DRIVING SIGNAL

(75) Inventors: Chung-Chun Lee, Yuan Lin Hsien (TW); Li-Wei Shih, Chia Yi Hsien (TW)

(73) Assignee: AU Optronics Corp., Hsinchu (TW)

( * ) Notice: Subject to any disclaimer, the term of this patent is extended or adjusted under 35 U.S.C. 154(b) by 1070 days.

(21) Appl. No.: 11/435,715

(22) Filed: May 18, 2006

(65) Prior Publication Data

US 2006/0262053 A1 Nov. 23, 2006

(30) Foreign Application Priority Data

May 19, 2005 (TW) ..... 94116279 A

(51) Int. Cl.
*G09G 3/32* (2006.01)
*G09G 5/10* (2006.01)

(52) U.S. Cl. ..... 345/83; 345/82; 345/690

(58) Field of Classification Search ..... 345/60–84, 345/204–214, 690–697
See application file for complete search history.

(56) References Cited

U.S. PATENT DOCUMENTS

2006/0012608 A1* 1/2006 Lee et al. ..... 345/600

FOREIGN PATENT DOCUMENTS

| | | | |
|---|---|---|---|
| CN | 1551707 | A | 12/2004 |
| JP | 2005-108528 | A | 4/2005 |
| KR | 10-2004-0096273 | A | 11/2004 |
| TW | 200424952 | A | 11/2004 |
| TW | 200540740 | A | 12/2005 |

* cited by examiner

*Primary Examiner*—David L Lewis
(74) *Attorney, Agent, or Firm*—Birch, Stewart, Kolasch & Birch, LLP

(57) ABSTRACT

A method of determining driving signals for a four-color organic electroluminescence device is provided. The driving signals are for displaying a predetermined color. A three-color organic electroluminescence device is a reference. The method comprises: a) defining a value of a white signal equal to the lowest value of a red reference signal, a green reference signal and a blue reference signal; b) defining a value of a red signal equal to the value difference between the red reference signal and the white signal, defining a value of a green signal equal to the value difference between the green reference signal and the white signal, defining a value of a blue signal equal to the value difference between the blue reference signal and the white signal; and c) adjusting the values of the red signal, the green signal or the blue signal for compensating color shifting.

12 Claims, 3 Drawing Sheets

METHOD OF DETERMINING OLED DRIVING SIGNAL

BACKGROUND OF THE INVENTION (1) Field of the Invention

The present invention generally relates to a method of determining driving signals for an organic electroluminescence device, and more particularly, to a full-color Active Matrix organic electroluminescence device, which comprises white organic light emitting diode (OLED).

(2) Description of the Prior Art

Organic electroluminescence device has the advantages of high luminance, high reactive speed, relatively thin and small size, full color and absence of backlight source. Therefore, it has been considered as one of the primary competitors of the Liquid Crystal Display (LCD) in the display market. In fact, the organic electroluminescence device has been applied to portable IT (Information Technology) product such as mobile phone, Personal Digital Assistant (PDA), digital camera or et cetera.

Technologies about fabricating the organic electroluminescence device are promoted rapidly in response to the market's demands. To display full colors, the typical means is utilizing a red sub-pixel, blue sub-pixel and a green sub-pixel, usually a red OLED, a blue OLED and a green OLED respectively, to compose a pixel. In other words, the traditional method, which is very common in the display field, is utilizing three primary colors to compose other colors that demand. A plurality of the mentioned pixel is arranged as an array and is disposed on the display panel so as to present full-color images. In the following paragraphs, "three-color organic electroluminescence device" indicates this kind of prior art.

Base on the consideration of electricity consumption, another technique was therefore provided. At least one white OLED is used to have a white sub-pixel, a red sub-pixel, a blue sub-pixel and a green sub-pixel so as to compose a single pixel having four primary colors. In the following paragraphs, "four-color organic electroluminescence device" indicates this art.

The electricity consumption of the four-color organic electroluminescence device only reaches half, or lower, of the three-color organic electroluminescence device. Its functions are described below correlating with FIG. 1A and FIG. 1B. FIG. 1A is a CIE chromaticity diagram of a prior three-color organic electroluminescence device. FIG. 1B is a CIE chromaticity diagram of a prior four-color organic electroluminescence device.

Please refer to FIG. 1A. While having a pixel display a predetermined color C1, in a three-color organic electroluminescence device, the red sub-pixel generates luminance R1; the blue sub-pixel generates luminance B1; and the green sub-pixel generates luminance G1, so as to compose the predetermined color C1.

Please refer to FIG. 1B. While having a pixel display a predetermined color C1, in a four-color organic electroluminescence device, the white sub-pixel generates luminance W1; the red sub-pixel generates luminance R2; the blue sub-pixel generates luminance B2; and the green sub-pixel generates luminance G2. Because the four-color organic electroluminescence device comprises the white OLED generating the luminance W1; and also because the white color is composed of red, green and blue. Luminance R2, luminance B2 and luminance G2 are respectively lower than luminance R1, luminance B1 and luminance G1 shown in FIG. 1A. In other words, adding the white sub-pixel is able to reduce the electricity consumption of the other three sub-pixels. Therefore, the general advantage of the four-color organic electroluminescence device over the three-color organic electroluminescence device is power saving.

However, there are still several problems to overcome while actually putting the four-color organic electroluminescence device on product lines. For example, the emission spectrum of the white OLED, under different operating voltages, shows relatively large shifting than OLEDs of other colors. Pleas refer to FIG. 2. It shows individual emission spectraspectra of white OLED under operating voltages of 5V, 6V, 7V and 8V, respectively. Obviously, the emission spectraspectra shift at a noteworthy level. As a result, it shows "different white" under different voltages, and the color shifting problem becomes the major drawback of four-color organic electroluminescence device.

The white OLED is relatively unstable as the red OLED, blue OLED and the green OLED. Under different operating voltages, the white OLED shows different white. Therefore, the proportion of red, green and blue from the white sub-pixel changes under different voltages. This may result in a drawback of color distortion. For this reason, to provide a four-color organic electroluminescence device, which has the remarkable power saving property, without the mentioned color distortion problem is the primary aim of the present invention.

SUMMARY OF THE INVENTION

An objective of the present invention is to improve the color shifting problem of prior four-color organic electroluminescence device.

Another objective of the present invention is to confront the color shifting property of white OLED, so as to provide proper driving signals for the four-color organic electroluminescence device.

Another objective of the present invention is to overcome the commercialized problem of the four-color organic electroluminescence device.

A method of determining driving signals for a pixel of a four-color organic Light Emitting Diode display is provided. The driving signals include a white signal, a red signal, a green signal and a blue signal to drive the pixel presenting a predetermined color. A three-color organic electroluminescence device is used as a reference. A pixel of the three-color organic electroluminescence device driven by a red reference signal, a green reference signal and a blue reference signal to present the same predetermined color. The method comprises following steps:

a) defining a value of the white signal equal to one of the red reference signal, the green reference signal and the blue reference signal that having the lowest value;

b) defining a value of the red signal equal to the value difference between the red reference signal and the white signal, defining a value of the green signal equal to the value difference between the green reference signal and the white signal, defining a value of the blue signal equal to the value difference between the blue reference signal and the white signal; and c) performing an adjusting step to adjust the values of the red signal, the green signal or the blue signal for compensating color shifting resulted from a white OLED of the pixel.

These and other objectives of the present invention will no doubt become obvious to those of ordinary skill in the art after reading the following detailed description of the preferred embodiment which is illustrated in the various figures and drawings.

BRIEF DESCRIPTION OF THE DRAWINGS

The present invention will now be specified with reference to its preferred embodiment illustrated in the drawings, in which.

DESCRIPTION OF THE PREFERRED EMBODIMENT

Figure 1A:
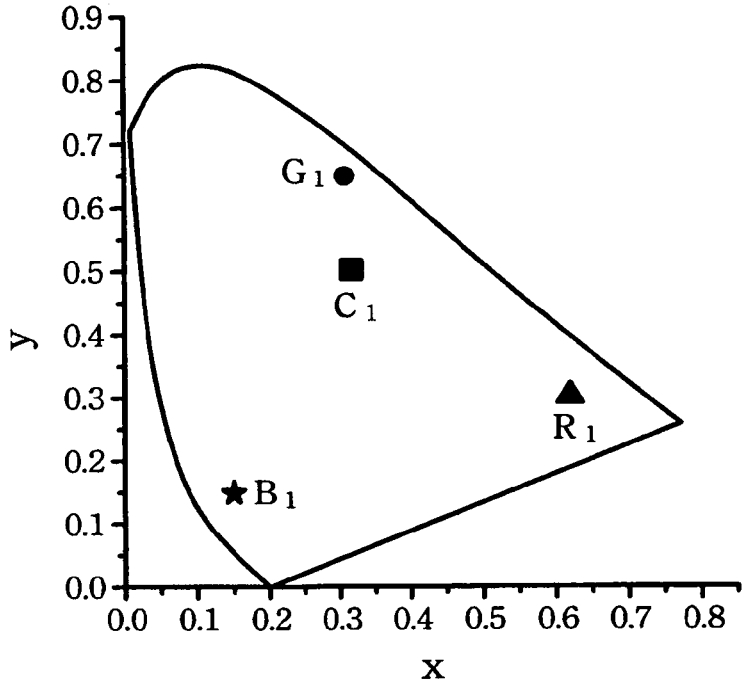
FIG. 1A (Related Art)
FIG. 1A is a CIE chromaticity diagram of a prior three-color organic electroluminescence device.
Figure 1B:
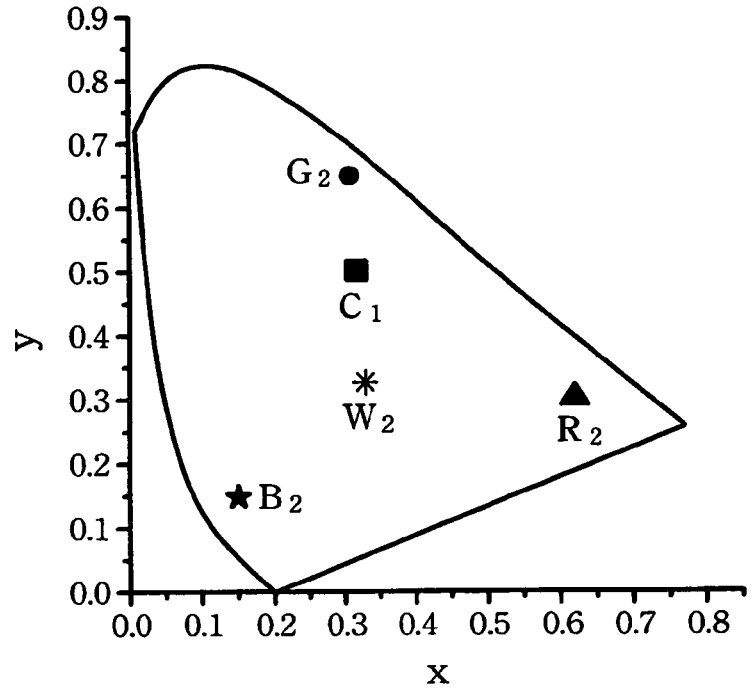
FIG. 1B (Related Art)
FIG. 1B is a CIE chromaticity diagram of a prior four-color organic electroluminescence device.
Figure 2:
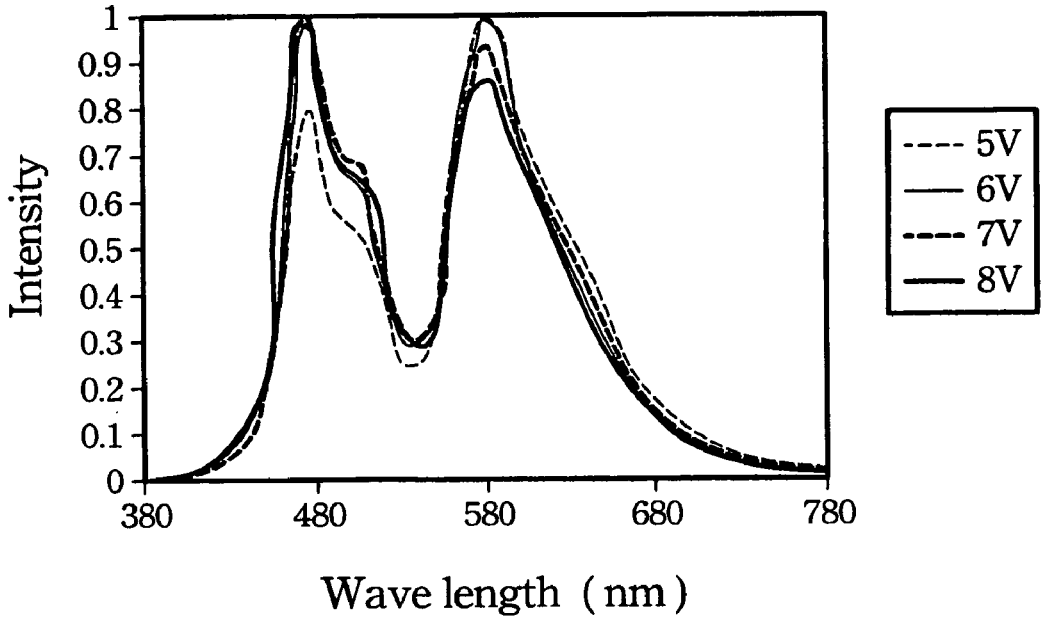
FIG. 2 (Related Art)
FIG. 2 shows individual emission spectra of white OLED under operating voltages of 5V, 6V, 7V and 8V.
Figure 3:
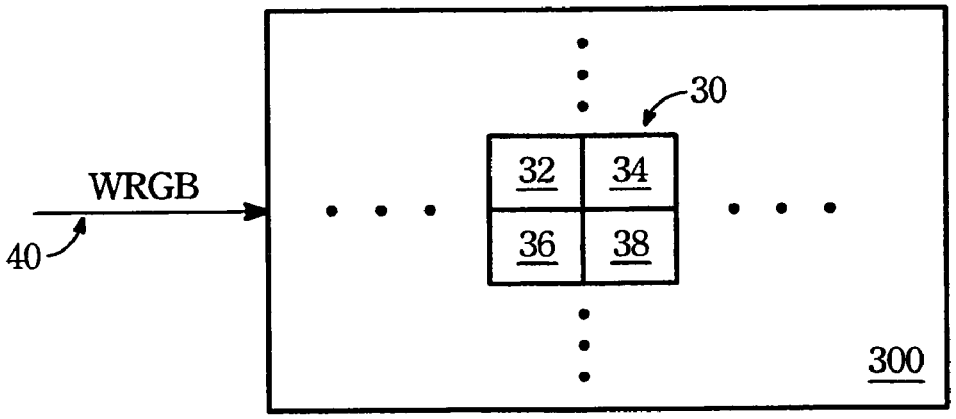
FIG. 3 illustrates driving signals, a four-color organic electroluminescence device and a pixel thereof.

Please refer to FIG. 3, which illustrates driving signals 40, a four-color organic electroluminescence device 300 and a pixel 30 thereof. The present invention generally relates to a method of determining driving signals 40 for the pixel 30. Surely, the present method is also suitable for the other pixels within the four-color organic electroluminescence device 300.

The pixel 30 includes a white sub-pixel 32, a red sub-pixel 34, a green sub-pixel 36 and a blue sub-pixel 38. There are a plurality of pixel 30 arranged as an array in the four-color organic electroluminescence device 300. Within the pixel 30, arrangement of the white sub-pixel 32, the red sub-pixel 34, the green sub-pixel 36 and the blue sub-pixel 38 are not limited to that shown in FIG. 3, any other possible order of these four sub-pixels are also applicable to the present invention.

In practice, a white OLED is adopted for the white sub-pixel 32 in one embodiment.

The red sub-pixel 34, the green sub-pixel 36 and the blue sub-pixel 38 are respectively a red OLED, a green OLED and a blue OLED. Alternatively, in another embodiment, each of them shall be white OLED plus red filter, green filter or blue filter. Applying color-converting layer to white OLEDs to form the red sub-pixel 34, the green sub-pixel 36 or the blue sub-pixel 38 is also practicable. Using blue OLEDs and applying color-converting layer or color filter on them to form the red sub-pixel 34 and the green sub-pixel 36 is another appropriate embodiment. However, these mentioned means for providing the needed four-color sub-pixels shall not be limit to the present invention.

The driving signals 40 include a white signal, a red signal, a green signal and a blue signal to drive the pixel 30 presenting a predetermined color. The white signal is used for driving the white sub-pixel 32 to generates its predetermined luminance. The red signal is used for driving the red sub-pixel 34 to generates its predetermined luminance. The green signal is used for driving the green sub-pixel 36 to generates its predetermined luminance. The blue signal is used for driving the blue sub-pixel 38 to generates its predetermined luminance.

The present invention is to provide a method of determining driving signals 40 for the pixel 30 to display a predetermined color, that is, determining the individual values of the white signal, the red signal, the green signal and the blue signal.

Driving mode shall not be limit to the present invention. Current driving mode or Voltage driving mode are either suitable for the present invention. In other words, the unit of the driving signals 40 can be either ampere or volt.

Following, steps are described in order, to disclose the present method:

<The First Step>

The first step is shutting down the white sub-pixel 32 and using only the red sub-pixel 34, the green sub-pixel 36 and the blue sub-pixel 38 to compose a predetermined color C1. In fact, while the white sub-pixel 32 is shut down, the four-color organic electroluminescence device 300 functions as same as a three-color organic electroluminescence device. This step is for taking a three-color organic electroluminescence device as a reference. And of course, using the original red, green and blue sub-pixels 34, 36 and 38 of the four-color organic electroluminescence device 300 to act as a pixel of three-color organic electroluminescence device will lead to the least experimental inaccuracy. After the white sub-pixel 32 has been shut down, driving signals according to three-color organic electroluminescence device of prior art are directly used to drive the pixel 30. Here, the relationship between the input signals and the out put color is expressed by the following equation:

$$C=rR+gG+bB \qquad \text{<Eq. 1>}$$

Within Eq. 1, the letter C represents a predetermined color that shall be out put. In the first step, the value of C shall be C1. The capital letters R, G and B respectively present pure red, pure green and pure blue. The small letter r represents value of the red signal, which relates to luminance of the red sub-pixel 34. Similarly, the small letter g represents value of the green signal, which relates to luminance of the green sub-pixel 36. The small letter b represents value of the blue sub-pixel 38, which relates to luminance of the blue sub-pixel 38.

Since the first step using driving signals of prior three-color organic electroluminescence device as reference, the values of the red signal, the green signal and the blue signal (r, g and b) in this step are also for reference. Therefore, the red signal, the green signal and the blue signal (which respectively have value of r, g and b) derived at the first step are taken as a red reference signal, a green reference signal and a blue reference signal.

<The Second Step>

The second step is recording the lowest value among the red reference signal, the green reference signal and the blue reference signal (The smallest among r, g and b).

<The Third Step>

The third step is turning on the white sub-pixel 32 and defining value of the white signal equal to the lowest value recorded at the second step. That is, defining value of the white signal equal to one of the red reference signal, the green reference signal and the blue reference signal that having the lowest value. Because the white sub-pixel 32 has been turned on, each of the red sub-pixel 34, green sub-pixel 36 and the blue sub-pixel 38 has to be adjusted (reduced) their luminance, so as to maintain the predetermined color C1. In this step, the relationship between the input signals and the out put color is expressed by the following equation:

$$C=rR+gG+bB+wW$$

$$\text{where } w=\min[r,g,b] \qquad \text{<Eq. 2>}$$

Within Eq. 2, "min [r,g,b]" represents the lowest value among r, g and b. r' represents value of the red signal after adjusting, which relates to luminance of the red sub-pixel 34. g' represents value of the green signal after adjusting, which relates to luminance of the green sub-pixel 36. b' represents value of the blue signal after adjusting, which relates to luminance of the blue sub-pixel 38. w represents value of the white signal 32.

About the method of determining values of the red signal, the green signal and the blue signal (method of determining r', g' and b'), a plurality of embodiments are provided below.

<The 1st Embodiment of Determining r', g' and b'>

Base on the concept of "white is composed of red, green and blue", the values of red signal, green signal and blue signal (r', g' and b' in Eq. 2) are set as Eq. 3:

$$r'=r-w$$

$$g'=g-w$$

$$b'=b-w \quad \text{<Eq. 3>}$$

The red sub-pixel 34, the green sub-pixel 36 and the blue sub-pixel 38 are provided with the red signal, the green signal and the blue signal with values according to Eq. 3. Further considering to the emission spectrum shifting property of the white OLED, which is at least adopted for the white sub-pixel 32, the value of r', g' and b' should be further fine tuned to maintain the pixel 30 displaying the predetermined color C1. This fine-tuned process requires spectrum analysis machine to detect the generated color of the pixel 30. After the predetermined color C1 has been confirmed, then recording the values of the red signal, green signal and blue signal (become r", g" and b" after fine tuned). Therefore, the proper values of individual white signal, red signal, green signal and blue signal for driving the pixel 30 presenting the predetermined color C1 are thus obtained:

$$C1=r''R+g''G+b''B+wW \quad \text{<Eq. 4>}$$

<The 2nd Embodiment of Determining r', g' and b'>

The Eq. 5 shown below is used in a preferred embodiment of the present invention:

$$r''=a1(r-w)+b1w$$

$$g''=a2(g-w)+b2w$$

$$b''=a3(b-w)+b3w \quad \text{<Eq. 5>}$$

In this embodiment, the emission spectrum analysis machine is also needed in this step and cooperated with a white balance process and a gamma adjusting process to determine values of the red signal, the green signal and the blue signal.

After substituting Eq. 5 into Eq. 2, obtaining:

$$C=a_1(r-w)R+a_2(g-w)G+a_3(b-w)B+b_1wR+b_2wG+b_3wB+wW \quad \text{<Eq. 6>}$$

Within Eq. 6, a1, a2, a3, b1, b2 and b3 are coefficients. Coefficients b1, b2 and b3 relate to the white balance process. Coefficients a1, a2 and a3 relate to the gamma adjusting process and respectively being used for adjusting a red gamma curve, a green gamma curve and a blue gamma curve. What is worth to be mentioned here is, according to the present invention, Eq. 6 is capable of presenting the relationship between the output color and the input driving signals 40 for all the embodiments. Method of determining the coefficients a1, a2, a3, b1, b2 and b3 is disclosed below:

[Method of Determining Coefficients b1, b2 and b3]

The primary objective of the present invention is to improve the color shifting problem resulting from the white OLED. Hence, after the white signal has been determined, the following step is to perform the white balance process, which needs to let the pixel 30 display "white" at first. To display "white", the values of the red signal, the green signal and the blue signal becomes equivalent and being equal to the value of the white signal. That is:

$$r=w$$

$$g=W$$

$$b=w$$

Therefore, inserting those value into the Eq. 6 and deriving:

$$C=b_1wR+b_2wG+b_3wB+wW \quad \text{<Eq. 7>}$$

Under the situation that coefficients b1, b2 and b3 all equal to zero, Eq. 7 will become:

$$C=wW \quad \text{<Eq. 8>}$$

Actually, the Eq. 8 represents only turning on the white sub-pixel 32. and the other three sub-pixels of the pixel 30 being shut off. This is the method to display "white" for prior four-color organic electroluminescence device. In other words, in the prior art, the method to display white is turning only the white-sub-pixel on. However, resulting from the color shifting property of white OLED, this kind of prior art is not preferred. The displayed white, according to this prior art, is usually not the "pure white". For this reason, the present invention uses coefficients b1, b2 and b3 shown in Eq. 7 to compensate the color shifting of the white sub-pixel 32.

Figure 4:
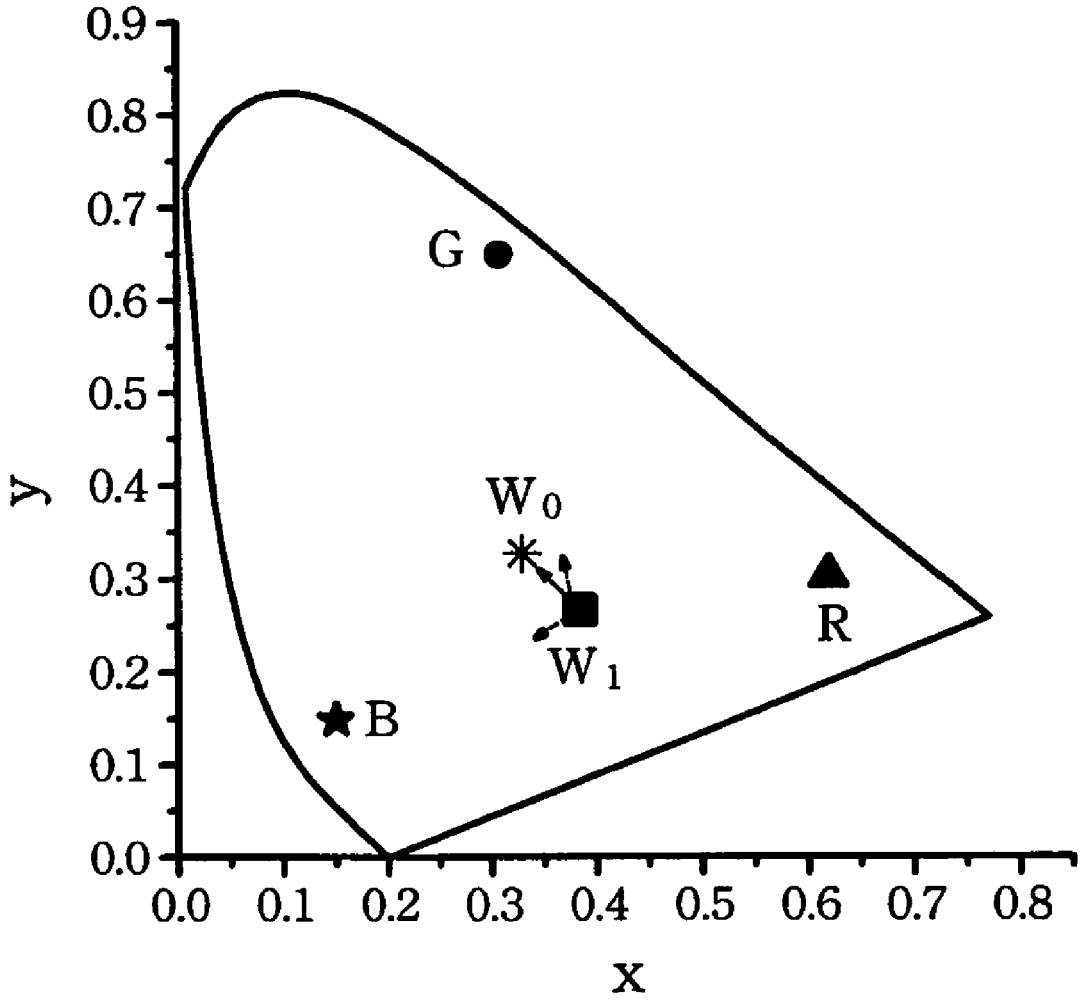
FIG. 4 shows a CIE chromaticity diagram of the present four-color organic electroluminescence device.

Please refer to FIG. 4, which shows a CIE chromaticity diagram of the present four-color organic electroluminescence device, for explaining Eq. 7. FIG. 4 presents an embodiment that the white sub-pixel 32 receives white signal of a relatively high voltage.

As shown in FIG. 4, the red sub-pixel 34 displays the red color located at the position "R" in the chromaticity diagram. Similarly, the green sub-pixel 36 displays the green color located at the position "G"; and the blue sub-pixel 38 display the blue color located at the position "B".

However, the white sub-pixel 34 displays a shifting white, resulting from the high voltage, which shifts toward purplish red. As shown in FIG. 4, the shifting white is located at the position "$W_1$", while the pure white is located at the position "$W_0$".

Therefore, in this embodiment, the values of the green signal and the blue signal are tuned up to enhance luminance of the green sub-pixel 36 and the blue sub-pixel 38. It means the coefficients b2 and b3 are increased to compensate the shifting white ($W_1$), so as to reach the pure white ($W_0$). In this embodiment, the coefficient b1 is able to be zero.

The above described white balance process and the Method of determining coefficients b1, b2 and b3 are able to be concluded into following steps:

1) While only turning on the white sub-pixel 32, detecting a difference (a shifting degree) between the shifting white ($W_1$) and the pure white ($W_0$).

2) Compensating the shifting white to the pure white by using one or combination of the red sub-pixel 34, the green sub-pixel 36 and the blue sub-pixel 38.

3) Recording the values of the red sub-pixel 34, the green sub-pixel 36 and the blue sub-pixel 38 to be a compensating red signal (b1*w*), a compensating green signal (b2*w*) and a compensating blue signal (b3*w*).

[Method of Determining Coefficients a1, a2 and a3]

Coefficients a1, a2 and a3 relate to the gamma adjusting process and respectively being used for adjusting a red gamma curve, a green gamma curve and a blue gamma curve. The gamma adjusting process is divided into a red gamma adjusting process, a green gamma adjusting process and a blue gamma adjusting process, where each of them is for obtained one of the coefficients a1, a2 or a3. Taking the red gamma adjusting process for instance, the method of determining coefficient a1, at first, needs to shut down the white sub-pixel 32, the green sub-pixel 36 and the blue sub-pixel 38. Here, the red sub-pixel 34 receives the red signal having the value of "a1(*r*−w)", where:

$$C=a1(r-w)R \quad \text{<Eq. 9a>}$$

According to the above mentioned steps, the "r" and "w" in Eq. 9a both have been determined. Therefore, the coefficient a1 is set to be 1 After then, cooperated with spectrum analysis machine to observe the red gamma curve of the pixel 30, the coefficient a1 is altered to fine tune the red signal. After the observed red gamma curve has been matched with a predetermined red gamma curve, which may be based on several kinds of specifications, the coefficient a1 is obtained.

Accordingly, the red gamma adjusting process, or the method of determining coefficient a1, is concluded into following steps:

1) Only turning on the red sub-pixel 34 of the four-color organic electroluminescence device.

2) Adjusting the value of the red signal (altering value of the coefficient a1) so that the red gamma curve matches a predetermined red gamma curve.

3) Recording the ratio of the value of the red signal before adjustment to the value of the red signal value after adjustment to be an adjusting coefficient a1.

As to the green gamma adjusting process and the blue gamma adjusting process, or the method of determining coefficient a2 and a3, the following equations are used:

$$C=a2(r-w)G \quad \text{<Eq. 9b>}$$

$$C=a3(r-w)B \quad \text{<Eq. 9c>}$$

The green gamma adjusting process and the blue gamma adjusting process are both performed with similar steps as the red gamma adjusting process, which is described above. Therefore, unnecessary details are not going to be mentioned here.

The general concept of the present invention is using the above steps to obtain w, r', g', b' of Eq. 2 and r, g, b of Eq. 1. In other words, according to the present invention, a table of driving signals for four-color organic electroluminescence device is able to be established instantly by using the ready-made driving signals' table, which is for three-color organic electroluminescence device.

In addition, the color shifting drawback of prior four-color organic electroluminescence device is well considered and has been improved according to the present invention.

The color shifting property of white OLED is mainly resulted from different operating voltages. The present invention has established an algorithm for deriving driving signals of four-color organic electroluminescence device from traditional three-color organic electroluminescence device. Once the coefficients (a1, a2, a3, b1, b2 and b3) under individual operating voltages, for white OLED, have been determined, the overall driving signals of the four-color organic electroluminescence device are established readily. In other words, to all of the colors having the same driving voltage for the white OLED, only one turn of the present method is required, which determines the coefficients (a1, a2, a3, b1, b2 and b3) for compensating the color shifting. Mentioned "one turn" of the present method is clearly described above. To conclude the present method, there are three primary steps listing below: a) defining a value of the white signal equal to one of the red reference signal, the green reference signal and the blue reference signal that having the lowest value; b) defining a value of the red signal equal to the value difference between the red reference signal and the white signal, defining a value of the green signal equal to the value difference between the green reference signal and the white signal, defining a value of the blue signal equal to the value difference between the blue reference signal and the white signal; and c) performing an adjusting step to adjust the values of the red signal, the green signal or the blue signal for compensating color shifting resulted from a white OLED of the pixel.

The amount of mentioned "turns" of the present method, which are needed to be performed, mainly relates to amount of existing white signals. Taking the digital form of 256 gray levels for example, surely, there are 256 different white signals. One embodiment of this situation is to perform 256 turns of the present method, so as to obtain 256 sets of coefficients (a1, a2, a3, b1, b2 and b3). Another embodiment is to perform less turns than 256, then using interpolation to derive the lacking coefficients. Somehow, the interpolation embodiment is able to accelerate the present method.

The color shifting problem of the four-color organic electroluminescence device is resulted from the white OLED. Therefore, while the other three primary colors (red, green and blue) is replaced by other atypical primary colors, the method according to the present invention is still applicable. For example, the red sub-pixel, the green sub-pixel and the blue sub-pixel may be replaced with a first-color sub-pixel, a second-color sub-pixel and a third-color sub-pixel. However, only the content of the driving signals of three-color organic electroluminescence device, which is used as a reference, is changed. The whole detail steps according to the present invention remains.

With the example and explanations above, the features and spirits of the invention are hopefully well described. Those skilled in the art will readily observe that numerous modifications and alterations of the device may be made while retaining the teaching of the invention. Accordingly, the above disclosure should be construed as limited only by the metes and bounds of the appended claims.

We claim:

1. A method of determining driving signals for a four-color organic electroluminescence device, wherein said driving signals include a white signal, a red signal, a green signal, and a blue signal to drive the pixel presenting a predetermined color, a three-color organic electroluminescence device being used as a reference, a pixel of the three-color organic electroluminescence device being driven by a red reference signal, a green reference signal, and a blue reference signal to present said predetermined color, the method comprising:

defining a value of the white signal to be the lowest value among the red reference signal, the green reference signal, and the blue reference signal;

defining a value of the red signal equal to the difference between the value of the red reference signal and the white signal, defining a value of the green signal equal to the difference between the value of the green reference signal and the white signal, and defining a value of the blue signal equal to the difference between the value of the blue reference signal and the white signal; and adjusting the values of the red signal, the green signal, or the blue signal to compensate color shifting resulted from a four-color organic electroluminescence device of the pixel, wherein the adjustment includes a white balance process comprising:

detecting a difference between a first color displayed while only turning on the white sub-pixel of a four-color organic electroluminescence device and a pure white;

compensating the first color to the pure white by using one or combination of the red sub-pixel, the green sub-pixel and the blue sub-pixel; and recording the values of the red sub-pixel, the green sub-pixel and the blue sub-pixel to be a compensating red signal, a compensating green signal, and a compensating blue signal.

2. The method of claim 1, wherein adjustment includes a red gamma adjusting process, comprising:

only turning on the red sub-pixel of the four-color organic electroluminescence device;

adjusting the value of the red signal so that the red gamma curve matches a predetermined red gamma curve; and recording the ratio of the value of the red signal before adjustment to the value of the red signal value after adjustment to be an adjusting coefficient.

3. The method of claim 1, wherein the adjustment includes a green gamma adjusting process including:

only turning on the green sub-pixel of the four-color organic electroluminescence device;

adjusting the value of the green signal so that the green gamma curve matches a predetermined green gamma curve; and recording the ratio of the value of the green signal before adjustment to the value of the green signal value after adjustment to be an adjusting coefficient.

4. The method of claim 1, wherein the adjusting step includes a blue gamma adjusting process including:

only turning on the blue sub-pixel of the four-color organic electroluminescence device;

adjusting the value of the blue signal so that the blue gamma curve matches a predetermined blue gamma curve; and recording the ratio of the value of the blue signal before adjustment to the value of the blue signal value after adjustment to be an adjusting coefficient.

5. A method of determining driving signals for a organic electroluminescence device having a white sub-pixel, a red sub-pixel, a green sub-pixel, and a blue sub-pixel, the driving signals including a white signal, a red signal, a green signal, and a blue signal, the method comprising following steps in order:

shutting the white sub-pixel and using the red sub-pixel, the green sub-pixel, and the blue sub-pixel to display a predetermined color;

recording the lowest value among the red reference signal, the green reference signal, and the blue reference signal;

turning on the white sub-pixel and defining the white signal equal to said lowest value;

adjusting the values of the red signal, the green signal, or the blue signal to display the predetermined color by the pixel, wherein the adjusting step includes a white balance process including:

detecting a difference between a first color displayed while only turning on the white sub-pixel of a four-color organic electroluminescence device and a pure white;

compensating the first color to the pure white by using one or combination of the red sub-pixel, the green sub-pixel and the blue sub-pixel; and recording the values of the red sub-pixel, the green sub-pixel and the blue sub-pixel to be a compensating red signal, a compensating green signal, and a compensating blue signal; and recording values of the red signal, the green signal, and the blue signal.

6. The method of claim 5, wherein the adjusting step includes a red gamma adjusting process including:

only turning on the red sub-pixel of the four-color organic electroluminescence device;

adjusting the value of the red signal so that the red gamma curve matches a predetermined red gamma curve; and recording the ratio of the value of the red signal before adjustment to the value of the red signal value after adjustment to be an adjusting coefficient.

7. The method of claim 5, wherein the adjusting step includes a green gamma adjusting process including:

only turning on the green sub-pixel of the four-color organic electroluminescence device;

adjusting the value of the green signal so that the green gamma curve matches a predetermined green gamma curve; and recording the ratio of the value of the green signal before adjustment to the value of the green signal value after adjustment to be an adjusting coefficient.

8. The method of claim 5, wherein the adjusting step includes a blue gamma adjusting process including:

only turning on the blue sub-pixel of the four-color organic electroluminescence device;

adjusting the value of the blue signal so that the blue gamma curve matches a predetermined blue gamma curve; and recording the ratio of the value of the blue signal before adjustment to the value of the blue signal value after adjustment to be an adjusting coefficient.

9. A method of determining driving signals for a pixel of a four-color organic electroluminescence device, wherein said driving signals include a white signal, a first-color signal, a second-color signal and a third-color signal to drive the pixel presenting a predetermined color, a three-color organic electroluminescence device being used as a reference, a pixel of the three-color organic electroluminescence device driven by a first-color reference signal, a second-color reference signal and a third-color reference signal to present said predetermined color, the method comprising following steps:

defining a value of the white signal equal to one of the first-color reference signal, the second-color reference signal and the third-color reference signal that having the lowest value;

defining a value of the first-color signal equal to the value difference between the first-color reference signal and the white signal, defining a value of the second-color signal equal to the value difference between the second-color reference signal and the white signal, defining a value of the third-color signal equal to the value difference between the third-color reference signal and the white signal; and performing an adjusting step to adjust the values of the first-color signal, the second-color signal or the third-color signal for compensating color shifting resulted from a white OLED of the pixel, wherein the adjusting step includes a white balance process including:

detecting a difference between a first color displayed while only turning on the white sub-pixel of a four-color organic electroluminescence device and a pure white;

compensating the first color to the pure white by using one or combination of the red sub-pixel, the green sub-pixel and the blue sub-pixel; and recording the values of the red sub-pixel, the green sub-pixel and the blue sub-pixel to be a compensating red signal, a compensating green signal, and a compensating blue signal.

10. The method of claim 9, wherein the adjusting step includes a first-color gamma adjusting process including:

only turning on the red sub-pixel of the four-color organic electroluminescence device;

adjusting the value of the red signal so that the red gamma curve matches a predetermined red gamma curve; and recording the ratio of the value of the red signal before adjustment to the value of the red signal value after adjustment to be an adjusting coefficient.

11. The method of claim 9, wherein the adjusting step includes a second-color gamma adjusting process including:

only turning on the green sub-pixel of the four-color organic electroluminescence device;

adjusting the value of the green signal so that the green gamma curve matches a predetermined green gamma curve; and recording the ratio of the value of the green signal before adjustment to the value of the green signal value after adjustment to be an adjusting coefficient.

12. The method of claim 9, wherein the adjusting step includes a third-color gamma adjusting process including:

only turning on the blue sub-pixel of the four-color organic electroluminescence device;

adjusting the value of the blue signal so that the blue gamma curve matches a predetermined blue gamma curve; and recording the ratio of the value of the blue signal before adjustment to the value of the blue signal value after adjustment to be an adjusting coefficient.

* * * * *